US010358913B2

(12) United States Patent
Richards

(10) Patent No.: US 10,358,913 B2
(45) Date of Patent: Jul. 23, 2019

(54) MOTOR MWD DEVICE AND METHODS

(71) Applicant: Schlumberger Technology Corporation, Sugar Land, TX (US)

(72) Inventor: Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 277 days.

(21) Appl. No.: 14/975,662

(22) Filed: Dec. 18, 2015

(65) Prior Publication Data

US 2016/0177703 A1 Jun. 23, 2016

Related U.S. Application Data

(60) Provisional application No. 62/095,172, filed on Dec. 22, 2014.

(51) Int. Cl.
*E21B 4/02* (2006.01)
*E21B 47/12* (2012.01)

(52) U.S. Cl.
CPC ..... *E21B 47/12* (2013.01); *E21B 4/02* (2013.01)

(58) Field of Classification Search
CPC ..... E21B 47/12; E21B 4/02
See application file for complete search history.

(56) References Cited

U.S. PATENT DOCUMENTS

| | | | | |
|---|---|---|---|---|
| 7,708,086 | B2 | 5/2010 | Witte | |
| 2002/0122722 | A1* | 9/2002 | Bertin | C22C 9/02 415/200 |
| 2005/0150689 | A1* | 7/2005 | Jogi | E21B 7/06 175/45 |
| 2006/0243493 | A1* | 11/2006 | El-Rayes | E21B 4/02 175/107 |
| 2013/0184995 | A1* | 7/2013 | Sinclair | G01V 11/00 702/9 |
| 2017/0051560 | A1* | 2/2017 | Slaughter, Jr. | E21B 7/12 |

* cited by examiner

*Primary Examiner* — D. Andrews
*Assistant Examiner* — Yanick A Akaragwe

(57) ABSTRACT

A progressive cavity positive displacement motor having a rotor and stator includes a measurements-while-drilling ("MWD") tool disposed within the rotor. The motor may use one or more alignment members to measure the position of the rotor relative to the stator. The MWD tool can collect data regarding physical properties such as orientation, temperature, pressure, and other properties. The MWD tool incorporated in the rotor is configured to measure differential properties near or at the uphole and downhole ends of the motor.

22 Claims, 8 Drawing Sheets

MOTOR MWD DEVICE AND METHODS

CROSS-REFERENCE TO RELATED APPLICATIONS

The present application claims the benefit of, and priority to, U.S. Provisional Patent Application No. 62/095,172, filed Dec. 22, 2014, which is hereby incorporated by reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. The formations through which the wellbore passes can be evaluated for a variety of properties, including the presence of hydrocarbon reservoirs in the formation, and the direction of the wellbore may be altered to optimize the location of the well in the formation. Wellbores may be drilled using a drill bit attached to the downhole end of a string of drill pipe. A directional drilling assembly may steer the drill bit through the formations based on information collected from the surrounding formations and measurements regarding the position and/or performance of the drilling system collected at the surface or below the surface.

For example, a bottomhole assembly may include one or more sensors at or near the drill bit, the directional drilling assembly, or other components of the bottomhole assembly. The sensors may monitor the performance of the bottomhole assembly and provide information regarding the navigation of the drill bit and bottomhole assembly through the formations. The information may be received by a computing device or by an operator that may interpret the information to steer the drill bit to form the wellbore.

The one or more sensors may be part of a measurements-while-drilling ("MWD") tool. The MWD tool may be a component of the bottomhole assembly and may be connected in series with other components of the bottomhole assembly including a motor, a logging-while-drilling ("LWD") tool, the drill bit, the directional drilling assembly, a communications module, or other components. Each additional component included in the bottomhole assembly increases the length of the bottomhole assembly and introduces a connection that may be a potential failure point. The length of the bottomhole assembly affects the ability of the drilling system to navigate the formations and drill the wellbore.

SUMMARY

This summary is provided to introduce a selection of concepts that are further described below in the detailed description. This summary is not intended to identify specific features of the claimed subject matter, nor is it intended to be used as an aid in limiting the scope of the claimed subject matter.

In a first non-limiting embodiment, a motor includes a stator with an opening therethrough. A rotor is positioned within the opening and configured to rotate relative to the stator. The rotor has a central bore therethrough with an MWD tool located in the central bore. The MWD includes an orientation measurement device, a power supply, and a communication module.

In a second non-limiting embodiment, a motor includes a stator with an opening and a longitudinal axis therethrough with a rotor positioned in the opening. The rotor is configured to rotate relative to the stator. The rotor has a central bore extending through a length of the rotor and the central bore has a front end and a second end. The motor has a first alignment member fixed relative to the stator and a second alignment member fixed relative to the rotor. An MWD tool is located in the central bore of the rotor and includes an orientation measurement device, a power supply, and a first communication module proximate the first end of the central bore. The first communication module is in data communication with at least one of the first alignment member and the second alignment member. The motor may also include a second communication module located proximate the second end of the central bore. The second communication module may be in data communication with the first communication module.

In a third non-limiting embodiment, a method of measuring physical properties in a downhole environment includes tripping a motor into a wellbore. The motor has a stator, a rotor, an MWD tool located within a central bore of the rotor. The method also includes flowing a drilling fluid through the motor to rotate the rotor relative to the stator. The flow of the drilling fluid is then stopped or reduced to stop rotational movement of the rotor relative to the stator, data is collected using the MWD tool, and the flow of drilling fluid is then increased through the motor to increase rotational movement of the rotor relative to the stator.

Additional features of embodiments of the disclosure will be set forth in the description which follows. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, these embodiments will be described and explained with additional specificity and detail through the use of the accompanying drawings in which.

DETAILED DESCRIPTION

One or more embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

One or more embodiments of the present disclosure may generally relate to devices, systems, and/or methods for collecting drilling information and/or data using a measurements-while-drilling ("MWD") tool located inside a motor. Further, one or more embodiments disclosed herein may relate to the calibration and/or orientation of an MWD tool within a motor in a downhole environment. Further still, one or more embodiments disclosed herein may relate to devices, systems, and/or methods of collecting drilling information and/or data regarding bit speed, bottomhole assembly ("BHA") orientation, fluid pressure, differential fluid pressure, other information, or combinations thereof during drilling fluid flow or no-flow conditions. In at least some embodiments, drilling information and/or data may be collected using an MWD tool within a motor during both drilling fluid flow and no-flow conditions. As used herein, "flow condition" may be understood to refer to a state in which drilling fluid circulates within a drilling system to provide energy to and operate a motor. "No-flow condition" may be understood to refer to a state in which drilling fluid does not circulate or circulates at a low enough rate and/or pressure that a motor does not operate (i.e., the rotor does not rotate). For example, the drilling fluid may have little or no force applied, e.g., via pump, to flow, or the drilling fluid may circulate too slowly or at too low pressure, or there is a fluid bypass in and/or around the motor that diverts fluid from the motor, each such that the motor does not operate.

Figure 1:
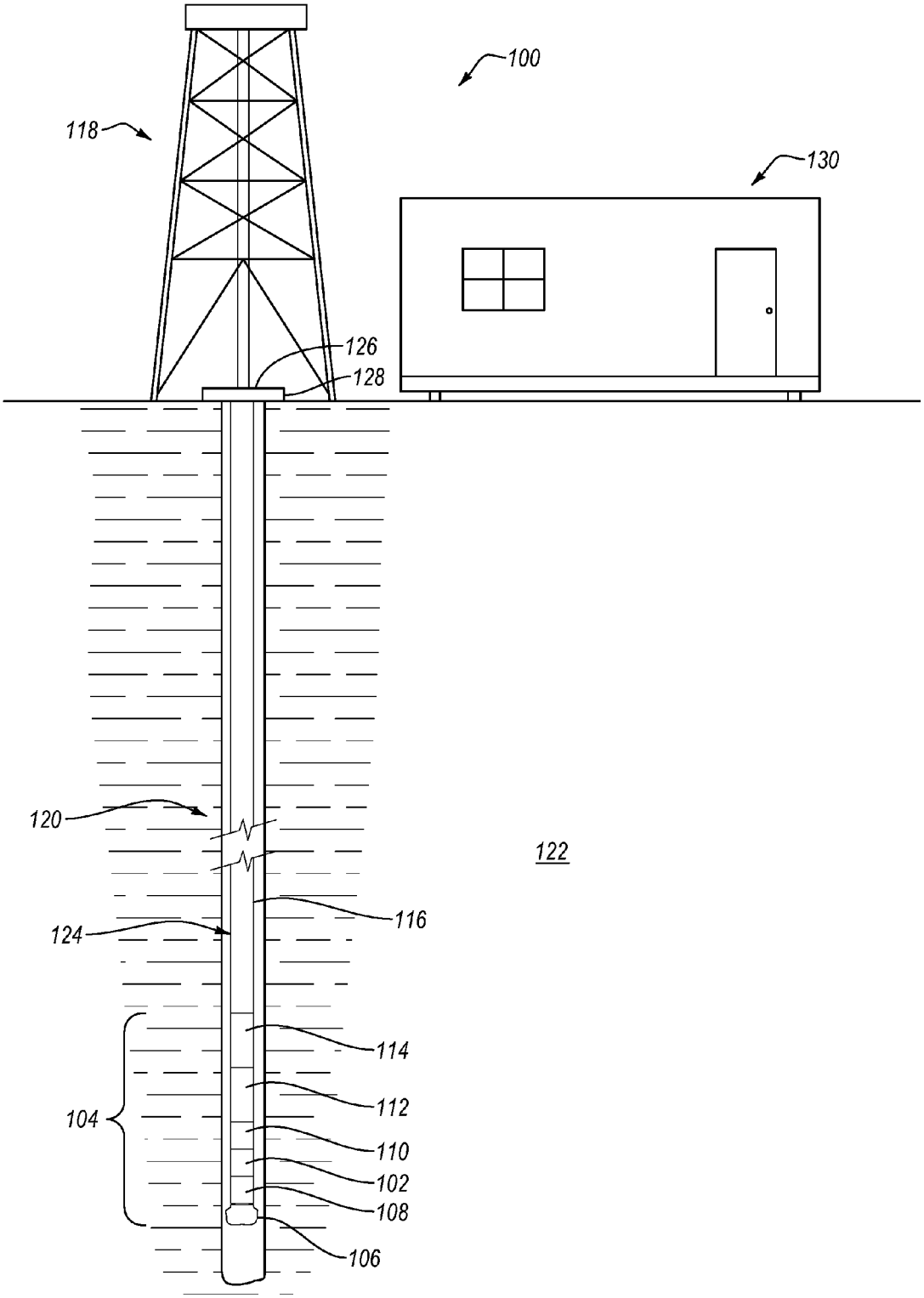
FIG. 1 is a schematic representation of a drilling system including a departure device placed in a wellbore, according to one or more embodiments of the present disclosure.

FIG. 1 illustrates a drilling system 100 including a motor 102, e.g., a progressive cavity positive displacement motor, with an incorporated MWD tool (not shown) in accordance with one or more embodiments of the present disclosure. It should be understood that various embodiments of a motor with an incorporated MWD tool may be the same or different, and features from various embodiments may be used in any combination with features of other embodiments. The motor 102 with an incorporated MWD tool may be part of a BHA 104. The BHA 104 may include one or more of a plurality of components such as a drill bit 106, a bit drive assembly 108, a steerable portion 110, a logging-while-drilling ("LWD") tool 112, one or more drill collars 114, other components, or combinations thereof. The BHA 104 may be connected to a tubular 116 that extends to a rig 118.

FIG. 1 also depicts a primary wellbore 120 extending downward into a formation 122. The term "primary wellbore," as used herein, refers to a wellbore from which a deviated or lateral borehole may begin. For example, a lateral borehole may be a sidetracked borehole that branches off of, or otherwise extends laterally from, the primary wellbore. The term "lateral" should be understood as describing a borehole extending at an angle from a longitudinal axis of the primary wellbore, and should not limit the application of the technique or techniques described herein. For example, a lateral borehole may extend from a lateral surface of a primary wellbore. In other words, a lateral borehole may extend at a non-parallel angle from a lateral surface of a primary wellbore. While the embodiments described herein may refer to one or more components being located or used in a primary wellbore, it should be understood that any device, system, or method described herein may be equally applicable to a lateral borehole.

A motor 102 may be positioned in the primary wellbore 120 as part of, for example, a drill string 124. The drill string 124 may include the tubular 116 and the BHA 104. The tubular 116 may include a number of components such as segmented drill pipe, coiled tubing, drill collars, transition pipe (e.g., HEVI-WATE® drill pipe), drill pipe, or similar components. The tubular 116 may transmit torque and/or longitudinal force through the primary wellbore 120 to the BHA 104. The BHA 104 may include the bit 106 configured to remove material from the formation 122 and/or to drill a lateral borehole extending from the primary wellbore 120. According to at least some embodiments, the BHA 104 may include a steerable portion 110 located on, near, or adjacent to the bit 106. In some embodiments, the steerable portion 110 may direct (i.e., guide) the bit 106. For example, the steerable portion 110 may direct the bit through the primary wellbore, a lateral borehole, or other borehole. A steerable portion 110 may be used in situations where the desired bit path is not straight or is entirely or at least partially straight. In some embodiments, the steerable portion 110 may direct both the bit 106 and the bit drive assembly 108. The bit drive assembly 108 may control rotational movement of the bit 106 relative to the BHA 104 and/or drill string 124. The BHA 104 may include a variety of sensors or data collection modules including the MWD tool. The data collection modules may collect information regarding the state of the fluid present in the formation 122, the state of the drilling system 100, other information, or combinations thereof.

The drill string 124 may transmit torque from, for example, a kelly 126 mated to a rotary table 128 at the surface. The rotary table 128 may have a kelly bushing (not shown) which may have an inside profile that may complimentarily mate with an outside profile of the kelly 126, such as a square, hexagon, or other polygonal shape that allows for the transmission of torque. The kelly 126 may move longitudinally freely relative to the rotary table 128 in order to transmit longitudinal force to the drill string 124. In other embodiments, the drill string 124 may be rotated by another torque transmitting device. For instance, a top drive (not shown) may be used to rotate the drill string 124.

The rotation and/or longitudinal movement of the drill string 124 may be controlled via a control system. The control system may receive information from, for example, the data collection modules and/or may send instructions to control the placement and/or rotational speed of the drill string 124. Where the data collection modules provide information used to direct the bit 106 within the primary wellbore 120 or drill a lateral borehole, the information may be used in a closed loop control system. For instance, pre-programmed software, hardware, firmware, or the like may enable the data collection modules to automatically steer the BHA 104 including the bit 106, when drilling the primary wellbore 120 and/or creating a lateral borehole. In other embodiments, however, the control system may be an open loop control system.

Information may be provided from the data collection modules to a controller (e.g., at the surface or in the BHA 104) or operator (e.g., at the surface). The controller or operator may review and/or process data signals received from the data collection modules and/or may provide instructions or control signals to the control system to direct drilling of the primary wellbore 120 and/or creating a lateral borehole. The data collection modules may include controllers positioned downhole and/or at the surface that may vary the operation of (e.g., steer or orient) the bit 106 or other portions of the bottomhole assembly 104. Mud pulse telemetry, wired drill pipe, fiber optic coiled tubing, wireless signal propagation, other information transmission techniques, or combinations thereof may be used to send information to or from the surface.

As shown in FIG. 1, information collected regarding the position, orientation, or other status of the drill string 124, formation 122, motor 102, or other portions of the drilling system 100 may be communicated to an operations center 130, depicted herein as a fixed operations center. In other embodiments, the operations center 130 may be a mobile operations center housed in a vehicle or a movable structure. The operations center 130 may be local or remote relative to the primary wellbore 120 and may include a computing system that may include a controller to receive and/or process data transmitted from the BHA 104 (e.g., data from the data collection modules and/or regarding the steerable portion 110, the bit 106, or the motor 102). While the drilling system 100 depicted in FIG. 1 is a land-based drilling system, it should be understood that at least one embodiment of the present disclosure is applicable to other drilling systems, including offshore rigs.

Figure 2:
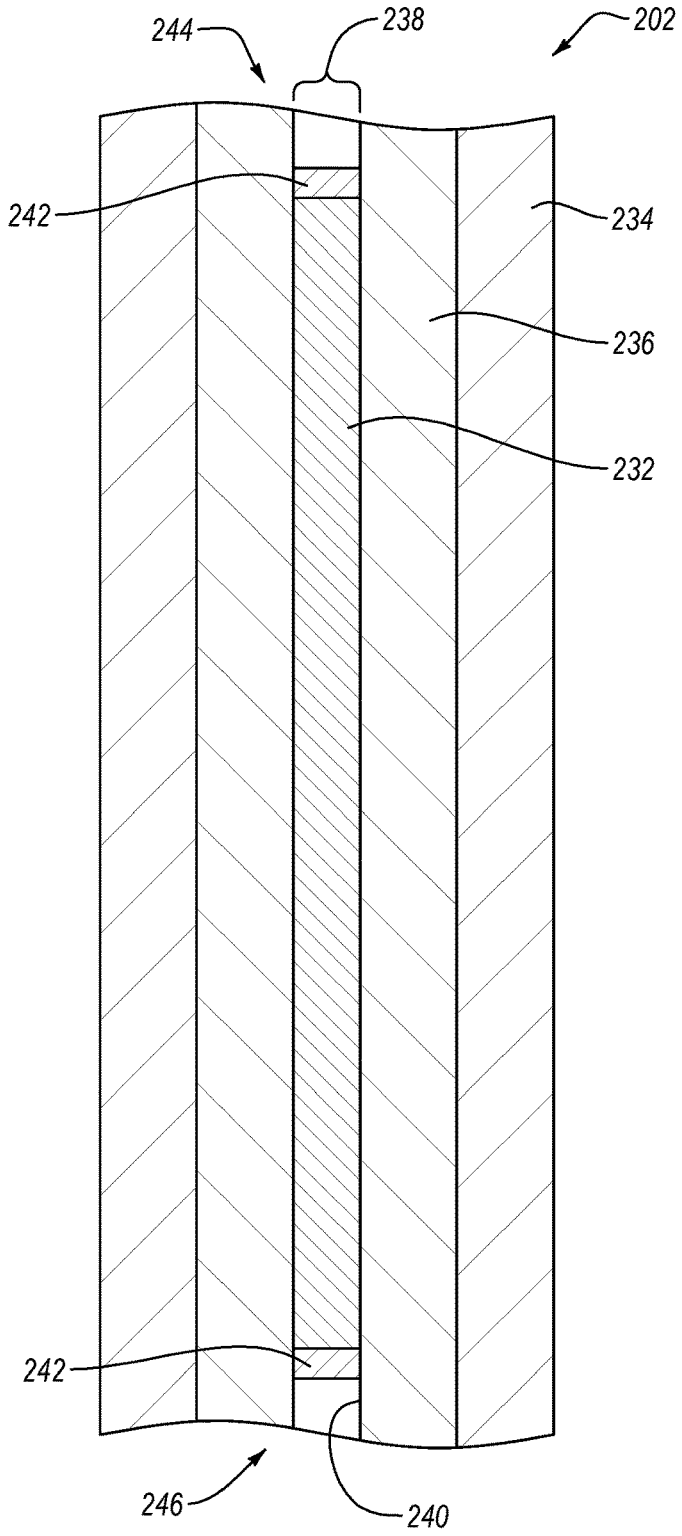
FIG. 2 is a schematic cross-sectional side view of a motor having an integrated measurements-while-drilling ("MWD") tool, according to one or more embodiments of the present disclosure.

FIG. 2 is a side cross-sectional view of an embodiment of a motor 202 having a MWD tool 232 positioned therein. The motor 202 may include a stator 234 and a rotor 236. The rotor 236 may have a central bore 238 therethrough. The MWD tool 232 may be incorporated into the motor 202. For example, the MWD tool 232 may be positioned with the central bore 238. In some embodiments, the MWD tool 232 may be configured to have a friction fit with a surface 240 of the central bore 238. In other embodiments, movement of the MWD tool 232 relative to the central bore 238 and/or motor 202 may be limited or substantially prevented by one or more retention members 242, e.g., a plug, cap, wedge, etc. The one or more retention members may be positioned proximate a first end 244 of the motor 202 and/or a second end 246 of the motor 202. The first end 244 and second end 246 of the motor 202 may be a proximal (uphole) and distal (downhole) end of the motor. The retention members 242 may be secured relative to the rotor 236 in the central bore 238 by any appropriate mechanism, including but not limited to threaded connections, pins, adhesives, welding, brazing, other connections, or combinations thereof. The one or more retention members 242 may also be at least partially integrally formed with the rotor 236.

The rotor 236 may rotate relative to the stator 234. The relative movement of the rotor 236 and stator 234 may provide mechanical or electrical energy to at least a portion of a BHA. For example, the relative movement of the rotor 236 and the stator 234 may provide mechanical energy to operate a bit. In another example, the relative movement of the rotor 236 and stator 234 may provide electrical energy, e.g., via a generator, to operate one or more sensors or data collection modules. In the depicted embodiment, the relative movement of the rotor 236 and the stator 234 may provide electrical energy to operate the MWD tool 232 located in the central bore 238 of the rotor 236.

Figure 3:
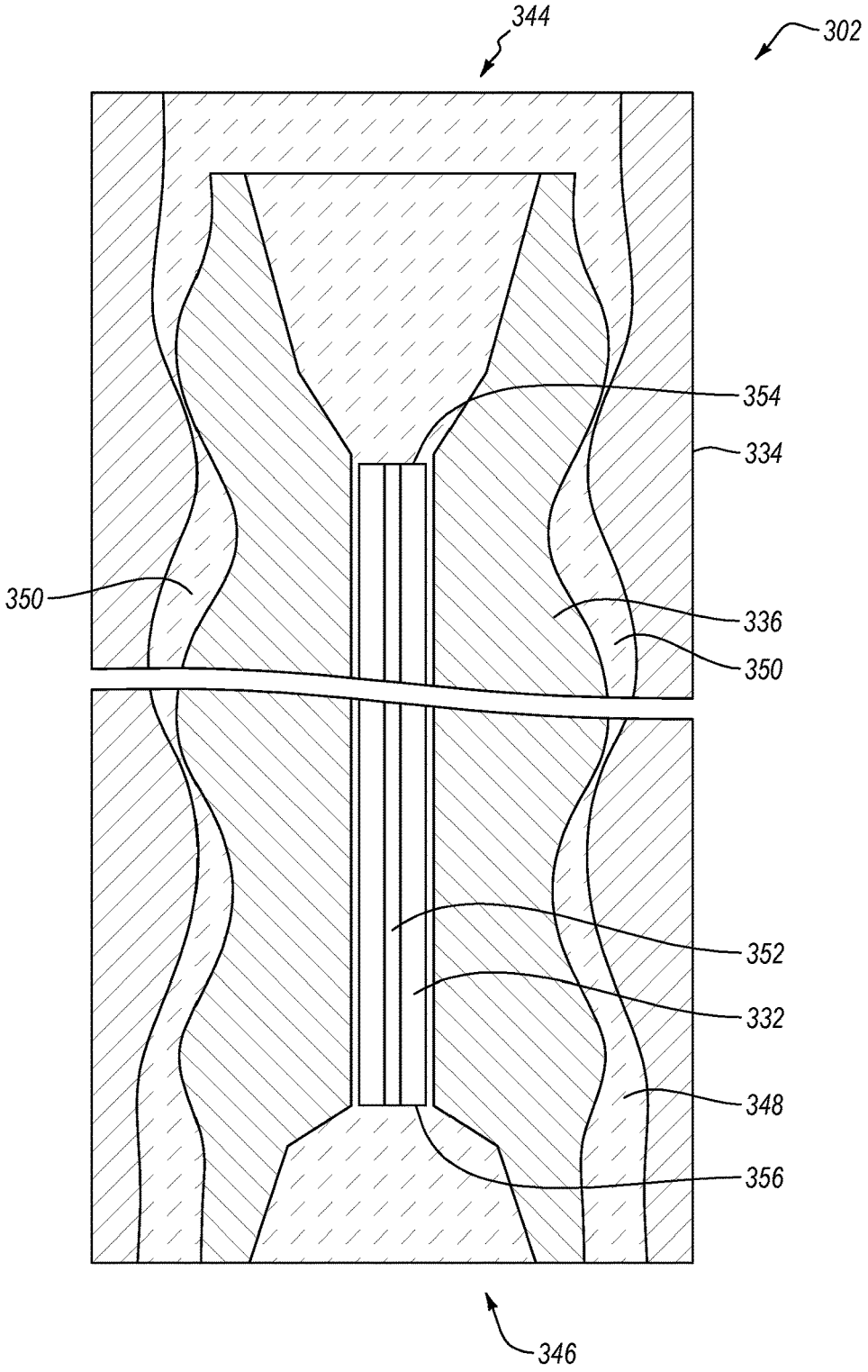
FIG. 3 is a cross-sectional side view of a progressive cavity positive displacement motor having an incorporated MWD tool, according to one or more embodiments of the present disclosure.

FIG. 3 is a side cross-sectional view of another embodiment of a motor 302 having an incorporated MWD tool 332. In some embodiments, the motor 302 may be a mud motor, such as a positive displacement cavity ("PDC") motor. In other embodiments, the motor 302 may be a turbine, an electric motor, or other type of motor. The motor 302 may use positive displacement of a drilling fluid 348 through a plurality of cavities 350 to rotate a rotor 336 relative to a stator 334. In some embodiments, the MWD tool 332 may limit or substantially prevent flow of the drilling fluid 348 through the rotor 336. In other embodiments, the MWD tool 332 may include a fluid bypass 352. The fluid bypass 352 may allow a portion of the drilling fluid 348 to flow through the rotor 336. The fluid bypass 352 may, therefore, allow at least a portion of the drilling fluid 348 through the motor 302 when the motor 302 is not operating or allow at least a portion of the drilling fluid 348 through the motor 302 without the drilling fluid 348 causing the rotor 336 to move relative to the stator 334. For example, an operator may reduce a flowrate and/or pressure of the drilling fluid 348 and allow a non-zero flowrate through at least a portion of a drilling system without causing the motor 302 to operate.

The MWD tool 332 may include one or more sensors to evaluate physical properties, such as pressure, temperature, and wellbore trajectory in three-dimensional space. An incorporated MWD tool 332 may measure differential properties above and below the motor 302. For example, an incorporated MWD tool 332 may have a proximal (uphole) end 354 and a distal (downhole) end 356. The incorporated MWD tool 332 may have one or more pressure sensors at the proximal end 354 and one or more pressure sensors at the distal end 356, i.e., a pressure measurement device. The pressure sensors at the proximal end 354 may allow the incorporated MWD tool 332 to monitor the input column pressure of the drilling fluid 348 applied to the motor 302, while the pressure sensors at the distal end 356 may allow the incorporated MWD tool 332 to monitor the output pressure of the drilling fluid 348 passing through the motor 302. For example, differential pressure data may allow software or an operator to evaluate the operating efficiency of the motor 302 during operation in a downhole environment. The MWD tool 332 may have one or more sensors located adjacent the fluid bypass 352. One or more sensors adjacent the fluid bypass 352 may allow the incorporated MWD tool 332 to monitor properties independent of the drilling fluid 348 passing through the motor 302. In some embodiments, the MWD tool 332 may include geological surveying equipment, such as a gamma sensor.

Figure 4:
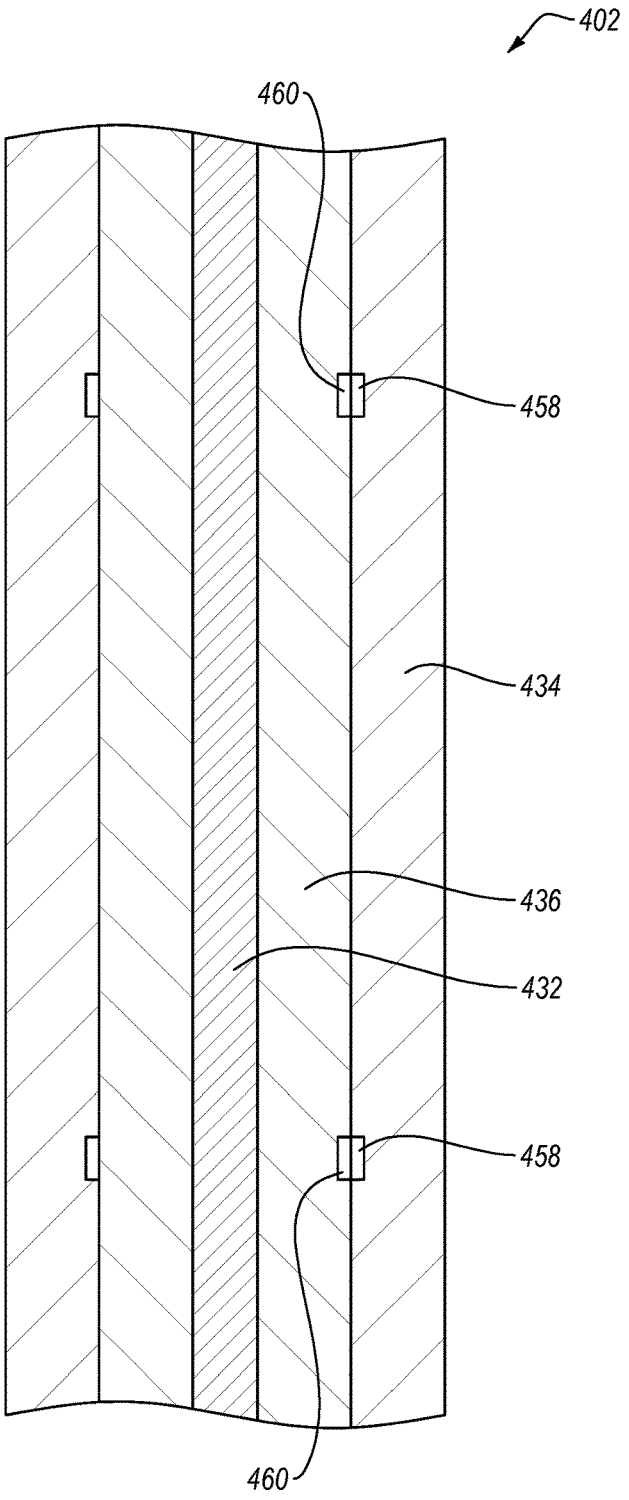
FIG. 4 is a schematic cross-sectional side view of a motor having an incorporated MWD tool and a plurality of alignment members, according to one or more embodiments of the present disclosure.

The incorporated MWD tool 332 may include one or more magnetometers and/or gyroscopes to measure the orientation of the MWD tool 332 in three-dimensional space. FIG. 4 depicts a schematic representation of an embodiment of a motor 402 having one or more first alignment members 458 and one or more second alignment members 460. The one or more first alignment members 458 may be located in or on a stator 434 of the motor 402. The one or more second alignment members 460 may be located in or on a rotor 436 of the motor 402. The one or more first alignment members 458 and one or more second alignment members 460 may be in communication with one another and configured to measure the proximity of at least one of the first alignment members 458 and at least one of the second alignment members 460 relative to each other. For example, one or more first alignment members 458 may be configured to monitor the relative position of a second alignment member 460 as the rotor 436 moves relative to the stator 434. In this way, a rate of rotor rotation (which in certain situations is indicative of bit speed) may be ascertained. In some embodiments, the rotor 436 may rotate eccentrically (i.e., an axis of rotation of the rotor 436 moves relative to the stator 434). In such embodiments, one or more first alignment members 458 may be configured to measure the rotational position of the rotor 436 relative to the stator 434 and the lateral displacement of the rotor 436 relative to the stator 434 based at least partially upon the relative location of one or more second alignment members 460.

The one or more first alignment members 458 and one or more second alignment members 460 may be in electromagnetic communication with one another. For example, at least one of the first alignment members 458 or at least one of the second alignment members 460 may include a magnet. In some embodiments, at least one of the first alignment members 458 and/or at least one of the second alignment members 460 may be or include an electromagnet. The electromagnet may be selectively magnetized by an electrical current applied to the electromagnet. An electromagnet may selectively or continuously monitor the relative position of one or more first alignment members 458 or/and one or more second alignment members 460. In other embodiments, at least one of the first alignment members 458 and/or at least one of the second alignment members 460 may be or include a permanent magnet, such as a rare-earth magnet housed in the stator 434 or a stator tube (not shown). In yet other embodiments, at least one of the first alignment members 458 and/or at least one of the second alignment members 460 may be or include a radio frequency identification ("RFID") device. The one or more first alignment members 458 or/and one or more second alignment members 460 may be configured to continuously monitor a position relative to one another or may selectively monitor a position, such as when the motor 402 is not operating (i.e., the drilling system is in a no-flow state). In yet further embodiments, the first alignment members 458 and/or second alignment members 460 may use mud pulse telemetry and/or electromagnetic telemetry to communicate position data to the surface.

A magnetic (e.g., ferromagnetic) stator 434 and/or rotor 436 may interfere with the positional measurements of the one or more magnetic first alignment members 458 and/or one or more magnetic second alignment members 460. The stator 434 and/or rotor 436 may be made of or include a non-magnetic material. For example, the stator 434 and/or rotor 436 may be made of or include non-magnetic stainless steel, titanium alloy, beryllium copper, aluminum alloy, other non-magnetic materials, or combinations thereof. In some embodiments, the MWD tool 432 may include one or more magnetometers and/or other orientation measurement devices. The one or more magnetometers and/or other orientation measurement devices may collect information regarding the orientation and/or position of the MWD tool 432 in three-dimensions relative to the Earth's magnetic field.

Figure 5:
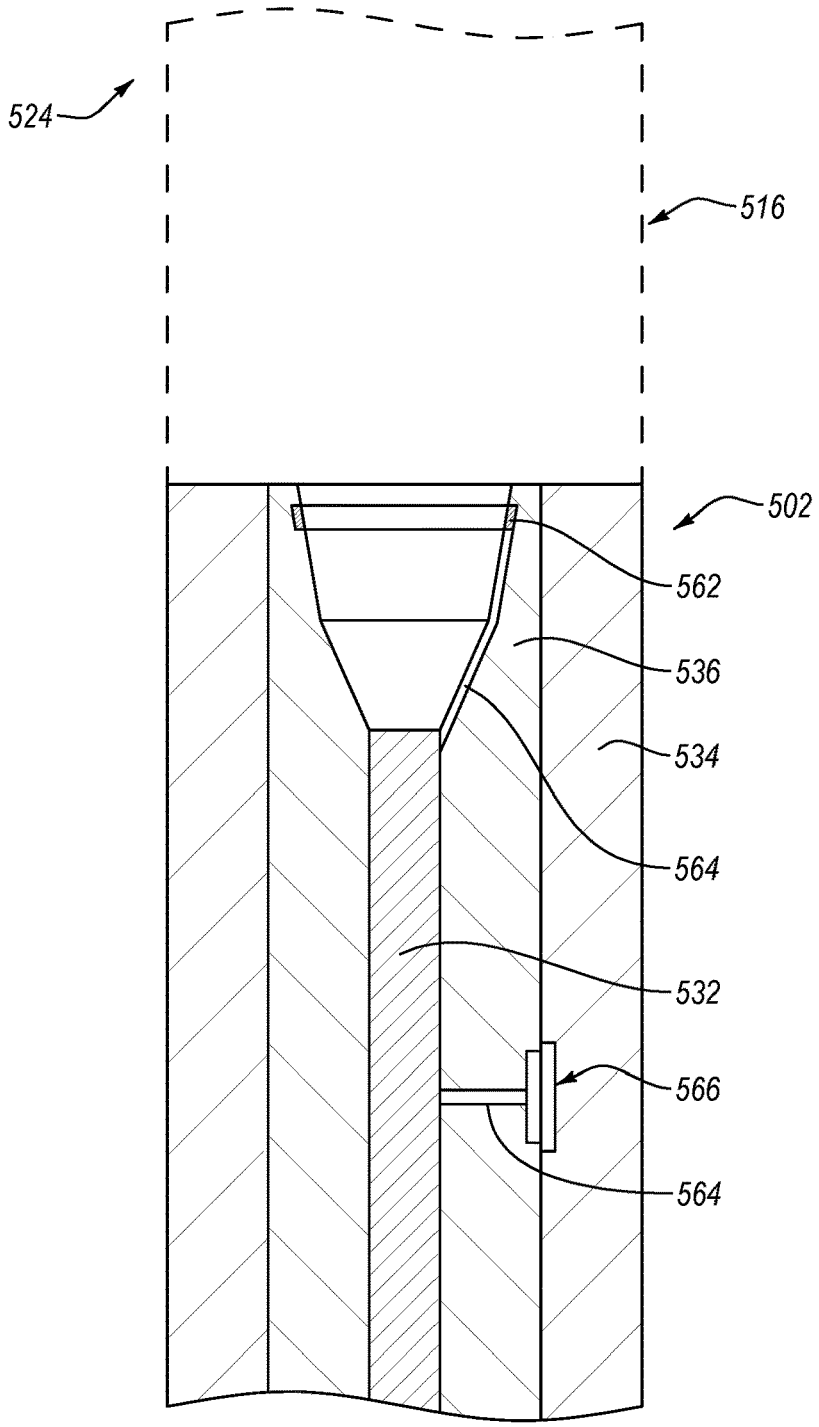
FIG. 5 is a schematic cross-sectional side view of a motor having an incorporated MWD tool and an electrical connection to an uphole component, according to one or more embodiments of the present disclosure.

FIG. 5 illustrates a motor 502 connected to a tubular 516 uphole of the motor 502. A tubular 516 may couple or may be fixed relative to a stator 534 of the motor 502. The rotor 536 may, therefore, be rotated relative to the tubular 516 uphole of the motor 502. Electrical energy may be provided to an incorporated MWD tool 532 in the motor 502 from an uphole source (not shown) through a drill string 524 including the tubular 516. The electrical energy may be conducted to the rotor 536 by an electrically conductive slip ring 562 on or in the rotor 536 and one or more wires 564 providing electrical communication between the slip ring 562 and the MWD tool 532. In some embodiments, the slip ring 562 may contact electrical terminals (not shown) in the tubular 516 or other uphole component. In other embodiments, the slip ring 562 may contact electrical terminals in the stator 534, which may be in electrical communication with the tubular 516 or other uphole component. In still other embodiments, slip ring 562 may be an inductive coupling which permits electrical energy to be transferred by induction between the stator 534/drill string 524 (via wire from the surface) and the rotor 536/MWD tool 532.

The relative rotation of the rotor 536 and stator 534 may generate electrical energy. The motor 502 may include an energy generation device 566 that generates electrical energy as a portion fixed to the rotor 536 passes a portion fixed relative to the stator 534. In some embodiments, the energy generation device 566 may be or include a dynamo. In other embodiments, the energy generation device 566 may be or include an alternator.

Figure 6:
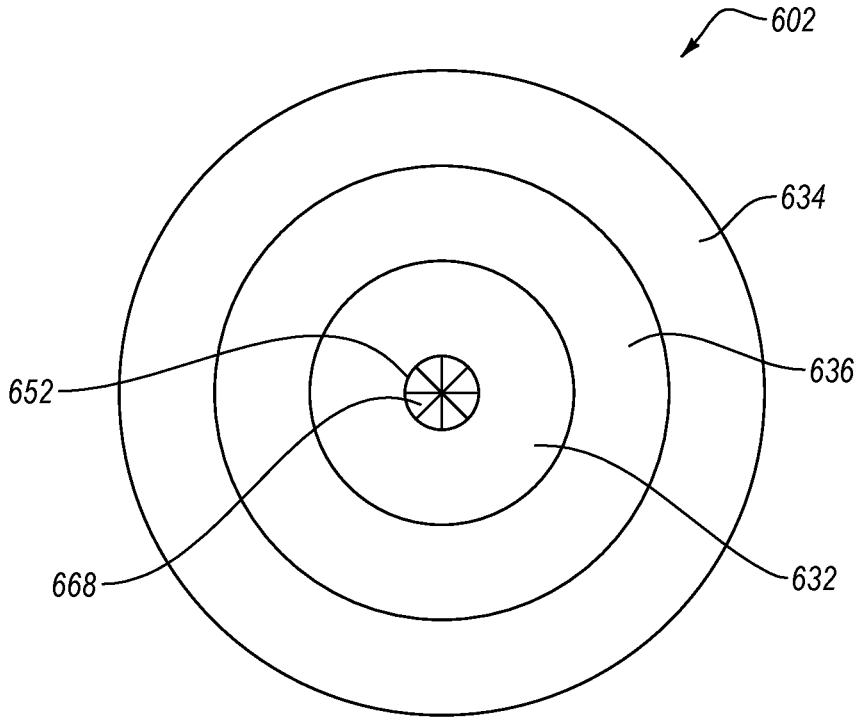
FIG. 6 is a schematic top view of a motor having an incorporated MWD tool with a fluid bypass and an energy generation device positioned in line with the fluid bypass, according to one or more embodiments of the present disclosure.

As shown in FIG. 6, in some embodiments, a motor 602 may include an energy generation device 668 positioned in-line within a fluid bypass 652 in an incorporated MWD tool 632, such that the MWD tool 632 has an on-board power supply. FIG. 6 is a top view of a motor 602 having an incorporated MWD tool 632 disposed inside a rotor 636. The rotor 636 may be positioned inside a stator 634. In some embodiments, the motor 602 may be a positive displacement motor. In such embodiments, the stator 634 may have a molded lining (not shown), e.g., an elastomer layer, that may interface with the rotor 636 to form at least one fluid cavity (not shown). Drilling fluid (not shown) flowing into the cavity applies a relative torque to the rotor 636 and stator 634, thereby causing the rotor 636 to rotate relative to the stator 634. At least a portion of the drilling fluid may flow through a fluid bypass 652 and may pass by and/or through the energy generation device 668. In some embodiments, the energy generation device 668 may be a turbine. In other embodiments, the energy generation device 668 may be another form of electrical generator.

Figure 7:
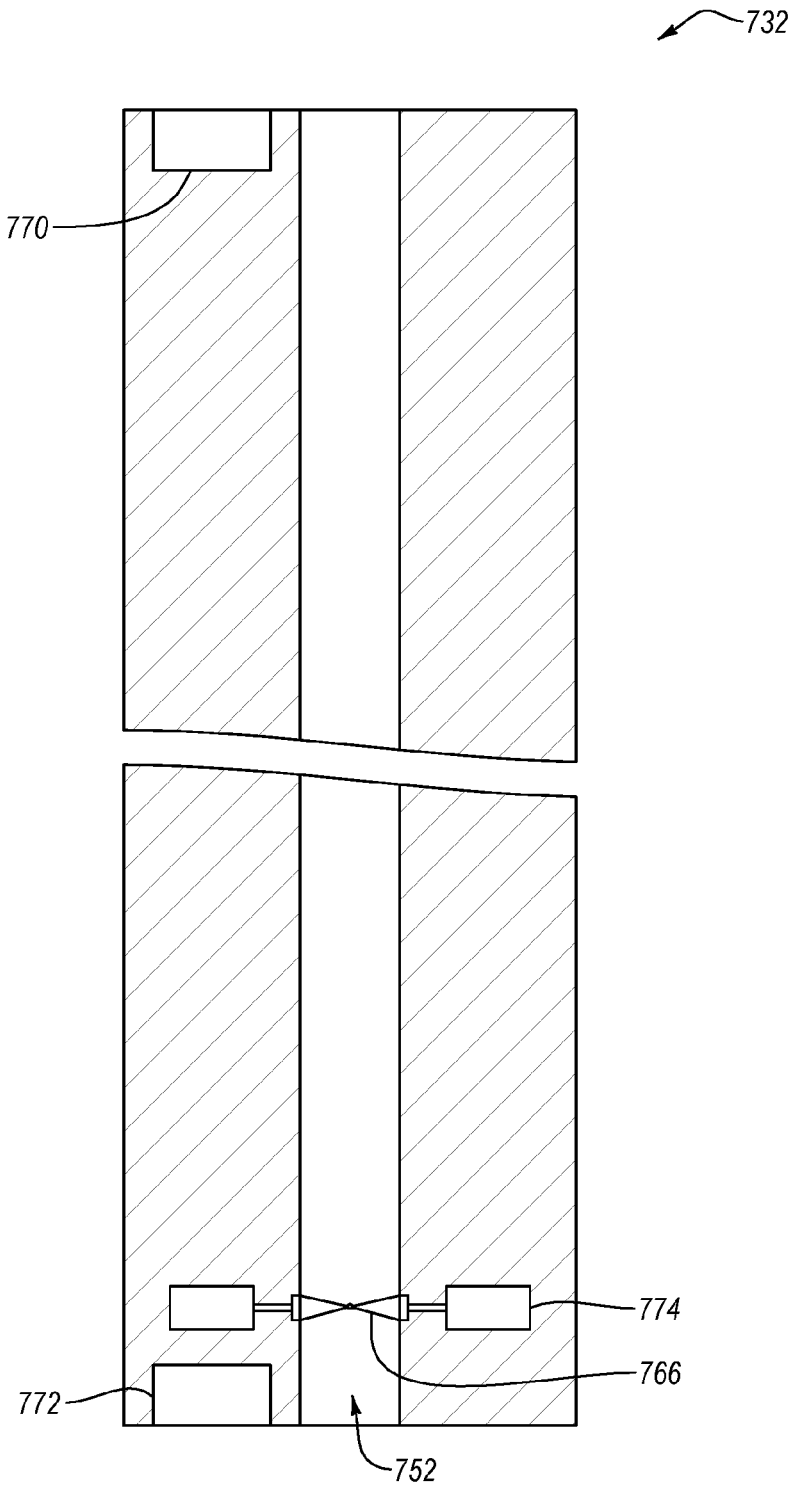
FIG. 7 is a schematic cross-sectional side view of an MWD tool having fluid bypass with an energy generation device, energy storage device, and one or more communication modules, according to one or more embodiments of the present disclosure.

Another embodiment of an MWD tool 732 that may be incorporated in a motor according to the present disclosure is depicted in FIG. 7. The MWD tool 732 may include a fluid bypass 752 and energy generation device 766 similar to those described in relation to FIG. 6. In other embodiments, the MWD tool 732 may receive electrical energy from other sources, as described in relation to FIG. 5. The MWD tool 732 may include one or more energy storage devices 774. In some embodiments, the one or more energy storage devices 774 may include rechargeable batteries. For example, the one or more energy storage devices 774 may be lithium-ion, lead-acid, nickel cadmium, nickel metal hydride, potassium-ion, another type of rechargeable battery, or combinations thereof. The energy storage devices 774 may receive electrical energy from the energy generation device 766 or from an external source, such as through the slip ring or inductive coupling described in relation to FIG. 5.

In some embodiments, the MWD tool 732 may have a first communication module 770. The first communication module 770 may be in data communication with one or more sensors, e.g., a first alignment member 458 or a second alignment member 460 of FIG. 4, in the MWD tool 732. The first communication module 770 may communicate collected data from the MWD tool 732 uphole to an operator or software at the surface. The first communication module 770 may also have a data storage device that permits the first communication module 770 to save the collected data from the one or more sensors for retrieval from the MWD tool 732 after the MWD tool 732 is removed from the downhole environment. The first communication module 770 may communicate data wirelessly or through a wired connection.

In other embodiments, the MWD tool 732 may having a first communication module 770 and a second communication module 772. The first communication module 770 may be in data communication with one or more sensors in the MWD tool 732 and with the second communication module 772. For example, the second communication module 772 may receive data from one or more components connected to a BHA (such as BHA 104 in FIG. 1) downhole from the MWD tool 732. In at least one embodiment, the second communication module 772 may receive data from the bit and communicate the data to the first communication module 770. The first communication module 770 may, in turn, communicate the data to an operator or software at the surface. While the first communication module 770 and the second communication module 772 are depicted in FIG. 7 as being in wireless communication with one another, it should be understood that the first communication module 770 and the second communication module 772 may be physically connected in data communication (i.e., via wire).

Figure 8:
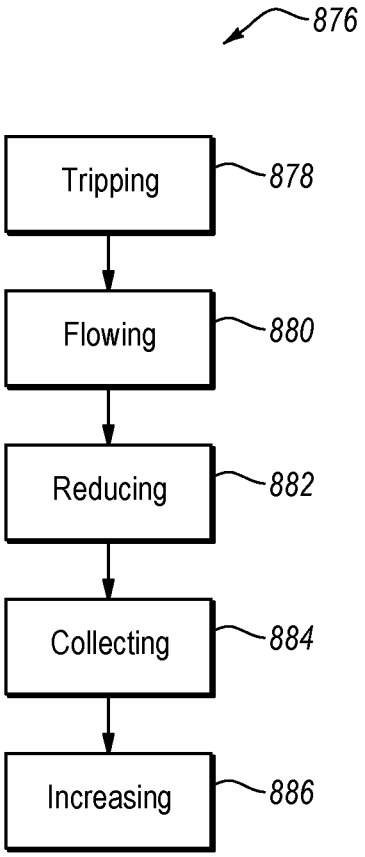
FIG. 8 is a flowchart depicting a method of measuring physical properties using a motor having an incorporated MWD tool, according to one or more embodiments of the present disclosure.

FIG. 8 depicts a method 876 of collecting measurements of physical properties using a motor with an incorporated MWD tool therein. The method 876 may include tripping 878 a drill string including a motor with an incorporated MWD tool therein into a downhole environment and flowing 880 a drilling fluid through the drill string and motor to operate the motor (i.e., to rotate the rotor relative to the stator). The method 876 may include reducing 882 the flow of the drilling fluid through the motor to stop movement/operation of the motor, collecting 884 data regarding one or more physical properties using the MWD tool, and then increasing 886 the flow of the drilling fluid through the motor to move/rotate the rotor. It should be understood that flowing 880 a drilling fluid through the motor to move/operate the motor may include increasing a low-flow or no-flow state to a flow rate and/or pressure of the drilling fluid to rotate a rotor and stator relative to one another. It should also be understood that reducing 882 the flow of the drilling fluid through the motor may include reducing and/or stopping the flow of drilling fluid such to induce a low-flow or no-flow state in which the flow rate and/or pressure of the drilling fluid may not induce movement/rotation of the rotor and stator relative to one another. For example, even when the motor is stopped, the drilling fluid may continue to flow at a lower but non-zero rate through the drill string and motor via a fluid bypass in the MWD tool or elsewhere in the motor.

The method 876 may further include transmitting the data to a remote computing device (e.g., at the surface) by either a wireless transmission, a wired transmission, direct transmission (i.e., removal of a data storage device from the MWD after removal from the wellbore), or combinations thereof. The method 876 may also include calibrating the MWD at least partially based upon the relative orientation of the rotor and stator. For example, position and/or orientation measurements may be collected by the MWD when stationary after stopping operation of the motor. The accuracy of the position and/or orientation measurements may be increased by determining the position of the rotor relative to the stator after stopping operation of the motor. In other examples, the MWD tool may collect data regarding position, orientation, pressure, temperature, rate of rotor rotation, other physical properties, or combinations thereof while the rotor is moving/rotating. The data collected while the motor is rotating may be averaged (e.g., a continuous rolling average) to reduce variations that may be imparted at least partially by the operation of the motor.

The method 876 may include receiving data from a component downhole from the motor, such as a bit, a bit drive assembly, or other component of a BHA. For example, the MWD tool may include a second communication module positioned at or near the distal (downhole) end of the MWD tool, as described in relation to FIG. 7, which may receive data from a downhole component and transmit the data to a first communication module positioned at or near a proximal (uphole) end of the MWD tool. In at least one embodiment, transmitting data from the second communication module to the first communication module may reduce the distance over which the data may be transmitted to an operator or software uphole from the MWD tool and/or reduce interference with a wireless transmission (e.g., electromagnetic transmission) of the data to an operator or software uphole from the MWD tool.

While embodiments of MWD tools have been primarily described with reference to wellbore drilling operations, the MWD tools described herein may be used in applications other than the drilling of a wellbore. In other embodiments, MWD tools according to the present disclosure may be used outside a wellbore or other downhole environment used for the exploration or production of natural resources. For instance, MWD tools of the present disclosure may be used in a borehole used for placement of utility lines, for tunneling underneath rivers, mountains and other surface features, etc. Accordingly, the terms "wellbore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

Those having ordinary skill in the art will realize, in view of the present disclosure, that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. It should be understood that "proximal," "distal," "uphole," and "downhole" are relative directions. As used herein, "proximal" and "uphole" should be understood to refer to a direction toward the surface, rig, operator, or the like. "Distal" or "downhole" should be understood to refer to a direction away from the surface, rig, operator, or the like.

Although only a few example embodiments have been described in detail above, those skilled in the art will readily appreciate that many modifications are possible in the example embodiments without materially departing from the disclosure. The embodiments described above, therefore, are to be considered as illustrative and not restrictive. Further, the scope of the disclosure is not limited by the appended claims or the foregoing description. Accordingly, all such modifications are intended to be included within the scope of the disclosure.

What is claimed:

1. A motor comprising:

a stator having an opening therethrough;

a rotor located in the opening and configured to rotate relative to the stator when a fluid is flowed radially between the stator and the rotor, the rotor having a central bore entirely therethrough, such that the central bore allows fluid flow axially through the rotor without causing the rotor to rotate relative to the stator; and a measurements-while-drilling ("MWD") tool located in the central bore of the rotor, the MWD tool including at least an orientation measurement device, a power supply, and a communication module in an MWD housing, one or more of the orientation measurement device, the power supply, and the communication module located entirely within the central bore of the rotor.

2. The motor of claim 1, wherein the rotor comprises a non-magnetic material.

3. The motor of claim 1, wherein the MWD tool further comprises a pressure measurement device.

4. The motor of claim 1, wherein the power supply is on-board and comprises a battery located in the stator or the rotor, or a dynamo provided by a combination of the stator and the rotor, or a combination of the battery and the dynamo.

5. The motor of claim 1, wherein the stator includes a first alignment member and the rotor includes a second alignment member, the first alignment member and the second alignment member being configured to monitor a position of the rotor relative to the stator.

6. The motor of claim 5, wherein at least one of the first alignment member or the second alignment member includes a magnet.

7. The motor of claim 1, further comprising a fluid bypass providing fluid communication from a first end of the central bore to a second end of the central bore.

8. The motor of claim 1, wherein the power supply of the MWD tool comprises:

an energy generation device extending in the central bore of the rotor, the energy generation device being configured to convert fluid flow in the central bore of the rotor into electrical current, wherein the energy generation device is electrically connected to a battery, the orientation measurement device, the communication module, or a combination thereof.

9. The motor of claim 1, wherein the power supply is located entirely within the central bore of the rotor.

10. A motor comprising:

a stator having a longitudinal axis and having an opening therein;

a rotor located in the opening and configured to rotate relative to the stator by flowing fluid radially between the stator and the rotor, the rotor having a central bore therethrough, the central bore having a first end and a second end, the first and second ends of the central bore being positioned proximal to or at opposite axial ends of the rotor, such that the central bore permits fluid flow through the rotor without rotating the rotor;

a first alignment member fixed relative to the stator;

a second alignment member fixed relative to the rotor; and an MWD tool located entirely in the central bore of the rotor, the MWD tool including at least an orientation measurement device, a power supply, and a first communication module proximate the first end of the central bore in a MWD housing, the first communication module being in data communication with at least one of the first alignment member and the second alignment member.

11. The motor of claim 10, wherein the stator is configured to couple to a downhole tool or tubular.

12. The motor of claim 10, further comprising a second communication module in data communication with at least the first communication module, the second communication module being proximate the second end of the central bore.

13. The motor of claim 10, wherein the stator comprises a non-magnetic material and the first alignment member comprises a permanent magnet.

14. A method of measuring physical properties in a downhole environment, the method comprising:

tripping a motor into a wellbore, the motor having a stator and a rotor, the rotor having an MWD tool located within a central bore of the rotor, the MWD tool including a plurality of sensors in an MWD housing;

flowing a drilling fluid through the motor to rotate the rotor relative to the stator;

reducing the flow of the drilling fluid through the motor to decrease rotation of the rotor relative to the stator;

collecting first data using the MWD tool after reducing the flow to decrease rotation of the rotor, wherein the drilling fluid flows axially through the rotor via the central bore at least while the flow is reduced, wherein fluid flow through the central bore does not cause the rotor to rotate relative to the stator; and increasing the flow of the drilling fluid through the motor to increase rotation of the rotor relative to the stator.

15. The method of claim 14, further comprising transmitting at least the first data to a remote computer device.

16. The method of claim 14, further comprising calibrating the MWD tool, wherein calibrating is based at least partially upon determining an orientation of the rotor relative to the stator.

17. The method of claim 14, further comprising calculating an orientation of the MWD tool relative to the stator.

18. The method of claim 14, further comprising collecting data while the rotor is rotating.

19. The method of claim 14, further comprising receiving second data from a downhole component and transmitting both the first data and the second data.

20. The method of claim 14, wherein the first data includes bit speed.

21. The method of claim 14, wherein the first data includes drilling fluid pressure.

22. The method of claim 14, further comprising generating energy using an energy generation device positioned in the central bore of the rotor, wherein the energy generation device is configured to convert energy from the fluid flow through the central bore of the rotor into electrical current.

* * * * *